US010570839B2

(12) United States Patent
Szwabowski et al.

(10) Patent No.: US 10,570,839 B2
(45) Date of Patent: Feb. 25, 2020

(54) SYSTEM AND METHOD FOR IMPROVING VEHICLE PERFORMANCE

(71) Applicant: FORD GLOBAL TECHNOLOGIES, LLC, Dearborn, MI (US)

(72) Inventors: Steven Joseph Szwabowski, Northville, MI (US); John Ottavio Michelini, Sterling Heights, MI (US); Dimitar Petrov Filev, Novi, MI (US); Craig Thomas Hodorek, Dearborn, MI (US); Eric Hongtei Tseng, Canton, MI (US); Davor Hrovat, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 1018 days.

(21) Appl. No.: 13/689,280

(22) Filed: Nov. 29, 2012

(65) Prior Publication Data

US 2014/0149017 A1 May 29, 2014

(51) Int. Cl.

| | |
|---|---|
| ***F02D 45/00*** | (2006.01) |
| ***F02D 41/02*** | (2006.01) |
| ***F02D 41/24*** | (2006.01) |
| ***F02D 11/10*** | (2006.01) |
| ***F02D 41/10*** | (2006.01) |

(52) U.S. Cl.

CPC ..... *F02D 41/021* (2013.01); *F02D 11/105* (2013.01); *F02D 41/10* (2013.01); *F02D 41/2451* (2013.01); *F02D 2200/50* (2013.01); *F02D 2200/501* (2013.01)

(58) Field of Classification Search

CPC ..... F02D 11/105; F02D 2200/50; B60W 2530/10; B60W 40/13; G01G 19/08; G01G 19/086; G01G 19/10; G01G 19/12; Y10S 477/90

See application file for complete search history.

(56) References Cited

U.S. PATENT DOCUMENTS 4,727,838 A * 3/1988 Oshiage ..... F02D 11/105 123/361
4,811,713 A * 3/1989 Shimada ..... F02D 11/105 123/361

(Continued)

FOREIGN PATENT DOCUMENTS

CN 102588127 A 7/2012
EP 0247626 A2 * 12/1987 ..... F02D 11/10

(Continued)

OTHER PUBLICATIONS

Anonymous, "Front-End Collision Avoidance through Automatic Transmission Shift Scheduling," IPCOM No. 000239148, Published Oct. 16, 2014, 2 pages.

(Continued)

*Primary Examiner* — John M Zaleskas
(74) *Attorney, Agent, or Firm* — Geoffrey Brumbaugh; McCoy Russell LLP

(57) ABSTRACT

Methods and systems for adjusting vehicle operation in response to vehicle weight are described. In one example, an adaptive driver demand correction is adjusted in response to vehicle weight. The methods and systems may provide for more consistent powertrain response and lower vehicle emissions at lower vehicle weights.

16 Claims, 8 Drawing Sheets

(56) References Cited

U.S. PATENT DOCUMENTS 4,961,315 A * 10/1990 Ishikawa ..... F16H 59/62 477/68
5,021,958 A * 6/1991 Tokoro ..... B60W 10/115 123/349
5,084,821 A * 1/1992 Ohsuga ..... B60T 13/10 701/101
5,305,662 A * 4/1994 Togai ..... B60W 10/06 477/43
5,406,862 A * 4/1995 Amsallen ..... F16H 59/52 477/900
5,434,780 A * 7/1995 Kume ..... F16H 59/14 192/3.29
5,465,208 A * 11/1995 Mochizuki ..... B60K 26/00 123/349
5,477,825 A * 12/1995 Hattori ..... B60K 31/047 123/399
5,495,251 A * 2/1996 Gilling ..... B60K 31/0008 180/167
5,508,923 A * 4/1996 Ibamoto ..... B60K 31/047 701/58
5,532,929 A * 7/1996 Hattori ..... B60K 31/047 123/361
5,598,336 A * 1/1997 Kume ..... F16H 59/14 123/361
5,665,026 A * 9/1997 Linden ..... B60K 31/047 180/170
5,740,044 A * 4/1998 Ehrenhardt ..... F02D 31/009 318/434
5,752,214 A * 5/1998 Minowa ..... B60K 31/0008 701/111
5,781,103 A * 7/1998 Gilling ..... B60K 31/0008 180/169
6,173,226 B1 * 1/2001 Yoshida ..... B60K 41/004 477/105
6,246,951 B1 * 6/2001 Robichaux ..... F02D 11/105 701/110
6,249,735 B1 * 6/2001 Yamada ..... B60T 8/18 701/65
6,304,806 B1 * 10/2001 Colby ..... F02D 11/105 701/110
6,304,809 B1 * 10/2001 Cullen ..... B60K 6/48 701/45
6,325,741 B1 * 12/2001 Kawai ..... F02D 11/105 123/399
6,367,447 B1 * 4/2002 Palansky ..... F02D 11/105 123/361
6,371,884 B1 * 4/2002 Channing ..... B60W 10/06 477/107
6,394,931 B1 * 5/2002 Genise ..... B60W 10/11 477/107
6,450,919 B2 * 9/2002 Kusafuka ..... F16H 61/0213 477/115
6,553,301 B1 * 4/2003 Chhaya ..... B60K 6/54 701/54
6,705,276 B1 3/2004 Sun et al.
6,803,530 B2 * 10/2004 Carlstrom ..... G01G 19/08 177/136
6,984,192 B2 * 1/2006 Markyvech ..... F02D 9/02 477/107
7,050,898 B2 * 5/2006 Ono ..... B60K 31/04 477/120
7,059,999 B2 * 6/2006 Glora ..... F02D 11/105 477/110
7,121,977 B2 * 10/2006 Markyvech ..... F02D 9/02 477/107
7,818,140 B2 * 10/2010 Dreier ..... F16H 59/52 177/136
7,873,452 B2 * 1/2011 Hawkins ..... B60W 10/02 177/136
8,224,549 B2 7/2012 Grubb
8,352,146 B2 * 1/2013 Doering ..... B60K 31/04 477/120
9,020,726 B2 * 4/2015 Boeckenhoff ..... B60W 10/06 701/70
2004/0158385 A1 * 8/2004 Nakano ..... B60K 31/04 701/104
2004/0211609 A1 * 10/2004 Schmitt ..... B60K 28/16 180/197
2004/0249542 A1 * 12/2004 Murasugi ..... F16H 61/0213 701/51
2005/0049771 A1 * 3/2005 Kuang ..... B60K 6/445 701/51
2005/0051133 A1 * 3/2005 Persson ..... F02D 11/105 123/396
2005/0171678 A1 * 8/2005 Takahashi ..... F02D 11/105 701/104
2007/0265805 A1 11/2007 Lee et al.
2008/0015767 A1 * 1/2008 Masuda ..... B60W 30/18036 701/99
2008/0114521 A1 * 5/2008 Doering ..... B60W 30/16 701/96
2009/0037047 A1 * 2/2009 Hawkins ..... B60W 10/02 701/36
2009/0216415 A1 * 8/2009 Iwatsuki ..... B60W 30/188 701/70
2009/0240415 A1 * 9/2009 Sukaria ..... B60T 8/172 701/84
2010/0036561 A1 * 2/2010 Jung ..... B60G 17/0195 701/37
2010/0049414 A1 * 2/2010 Ohtomo ..... B60L 3/08 701/70
2010/0063666 A1 * 3/2010 Schumann ..... B60T 8/1708 701/31.4
2010/0114437 A1 * 5/2010 Boss ..... B60K 28/08 701/48
2010/0235039 A1 * 9/2010 Kajigai ..... B60W 40/02 701/31.4
2011/0106388 A1 * 5/2011 Boeckenhoff ..... B60W 10/06 701/70
2011/0191010 A1 * 8/2011 Russ ..... F02M 25/07 701/108
2011/0251747 A1 * 10/2011 Imai ..... B60K 6/445 701/22
2011/0257867 A1 * 10/2011 Walker ..... F02D 41/0007 701/103
2012/0234004 A1 * 9/2012 Stoffels ..... F02D 23/00 60/605.1
2012/0296541 A1 * 11/2012 Matsushita ..... B60W 10/06 701/70
2014/0330500 A1 * 11/2014 Minase ..... B60W 50/038 701/70

FOREIGN PATENT DOCUMENTS

JP 62282148 A * 12/1987 ..... F02D 11/10
JP 62298638 A * 12/1987
JP 01294925 A * 11/1989
KR 20070060909 A * 6/2007
WO 2009071104 A1 6/2009

OTHER PUBLICATIONS

Anonymous, "Accelerator Pedal Position Control with External Device," IPCOM No. 000241547, Published May 8, 2015, 4 pages.
Anonymous, "Stationary Vehicle Mass Estimation," IPCOM No. 000230758, Published Sep. 10, 2013, 3 pages.
Partial Translation of Office Action of Chinese Patent Application No. 201310625842.1, dated Mar. 17, 2017, State Intellectual Property Office of PRC, 13 pages.

* cited by examiner

SYSTEM AND METHOD FOR IMPROVING VEHICLE PERFORMANCE

BACKGROUND/SUMMARY

Vehicles that have higher gross vehicle weights (GVW) are specifically designed to carry and tow amounts of weight that may not be typically associated with passenger vehicles. Such vehicles may be used for construction, recreation, and commercial purposes. Even though these vehicles may sometimes operate at weights that are far below the GVW, the vehicles are designed to deliver adequate part accelerator pedal performance in both laden and un-laden conditions. Further, the vehicles may be required to meet performance metrics at the GVW so that the customer receives a vehicle that performs well at the GVW. However, a vehicle that is operating at its GVW may perform significantly different than a vehicle that is operating at its base vehicle weight. For example, the vehicle may accelerate better at its base weight as compared to when operating at its GVW. Additionally, the improved vehicle acceleration may come at the expense of decreased fuel economy.

The inventors herein have recognized the above-mentioned disadvantages and have developed a method for operating an engine of a vehicle, comprising: providing a driver input device for determining a driver demand torque; transforming a signal from the driver input device into a driver demand torque via a transfer function that is based on operating the vehicle at a gross vehicle weight; and adapting the transfer function in response to vehicle weight being less than a gross vehicle weight.

By adapting a transfer function that influences driver demand torque in response to vehicle weight being less than a gross vehicle weight, it may be possible to provide more consistent vehicle performance over a wider range of vehicle weights. Further, it may be possible to provide improved fuel economy at higher driver demands when the vehicle is operated at a lower weight. For example, a driver demand transfer function may be based on performance objectives and emissions for operating a vehicle at its GVW. If the vehicle is operated at less than its GVW, the driver demand transfer function may be adapted to provide the same level of vehicle performance (e.g., acceleration) at the reduced vehicle weight. Maintaining the same level of vehicle performance at the lower vehicle weight as at the higher vehicle weight may allow higher fuel efficiency to be achieved at lower vehicle weights. Additionally, the vehicle may perform more consistently over a wider range of vehicle weights so that the driver may expect a certain level of performance irrespective of vehicle weight.

The present description may provide several advantages. In particular, the approach may improve vehicle fuel economy when a vehicle is operated at lower vehicle loads. Further, the approach may provide a more consistent level of vehicle performance even in the presence of varying vehicle loads. Further still, the approach may reduce wear of driveline components such as transmission clutches since the vehicle may operate with less variation.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
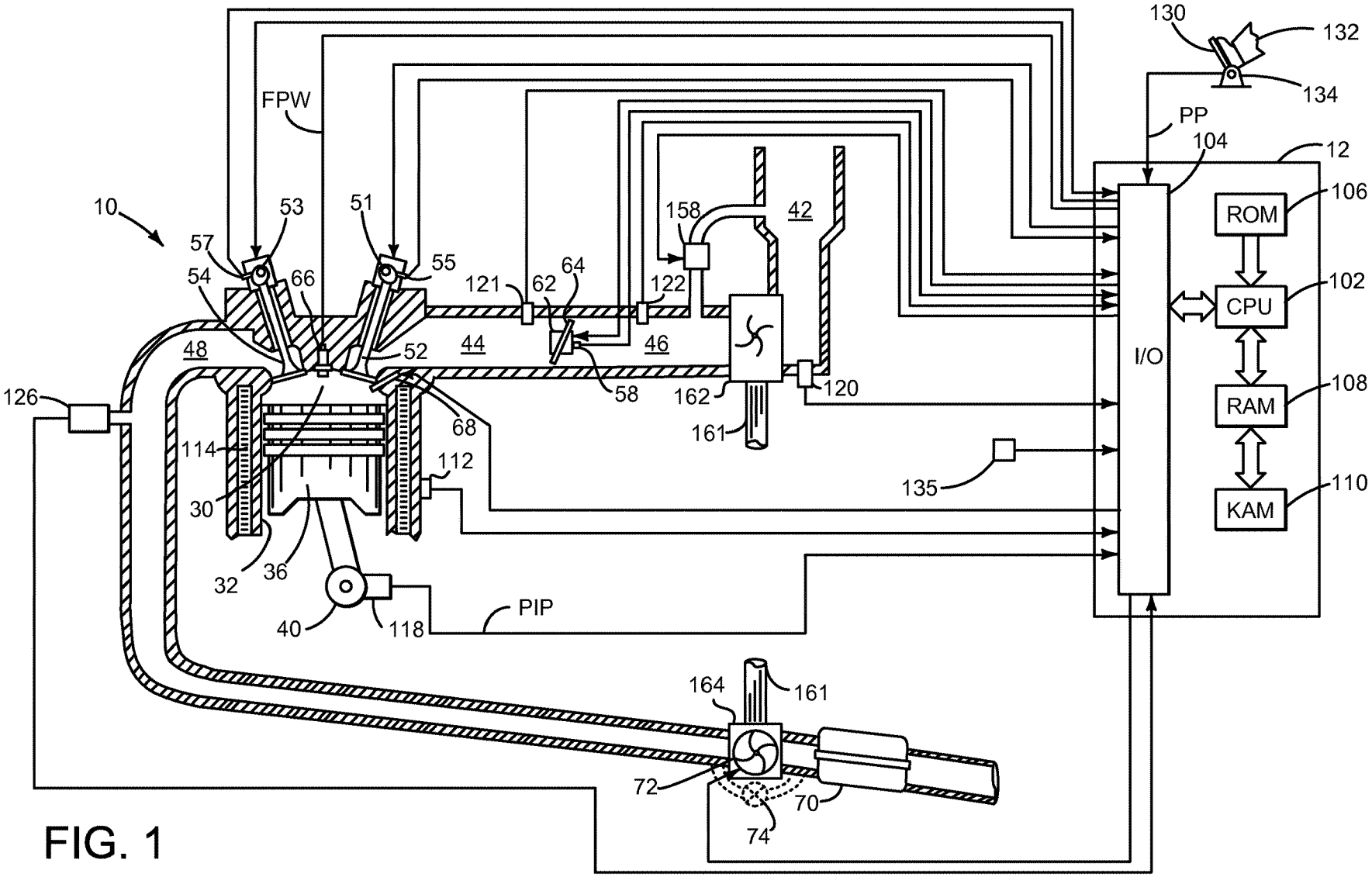
FIG. 1 shows a schematic depiction of an engine.
Figure 3:
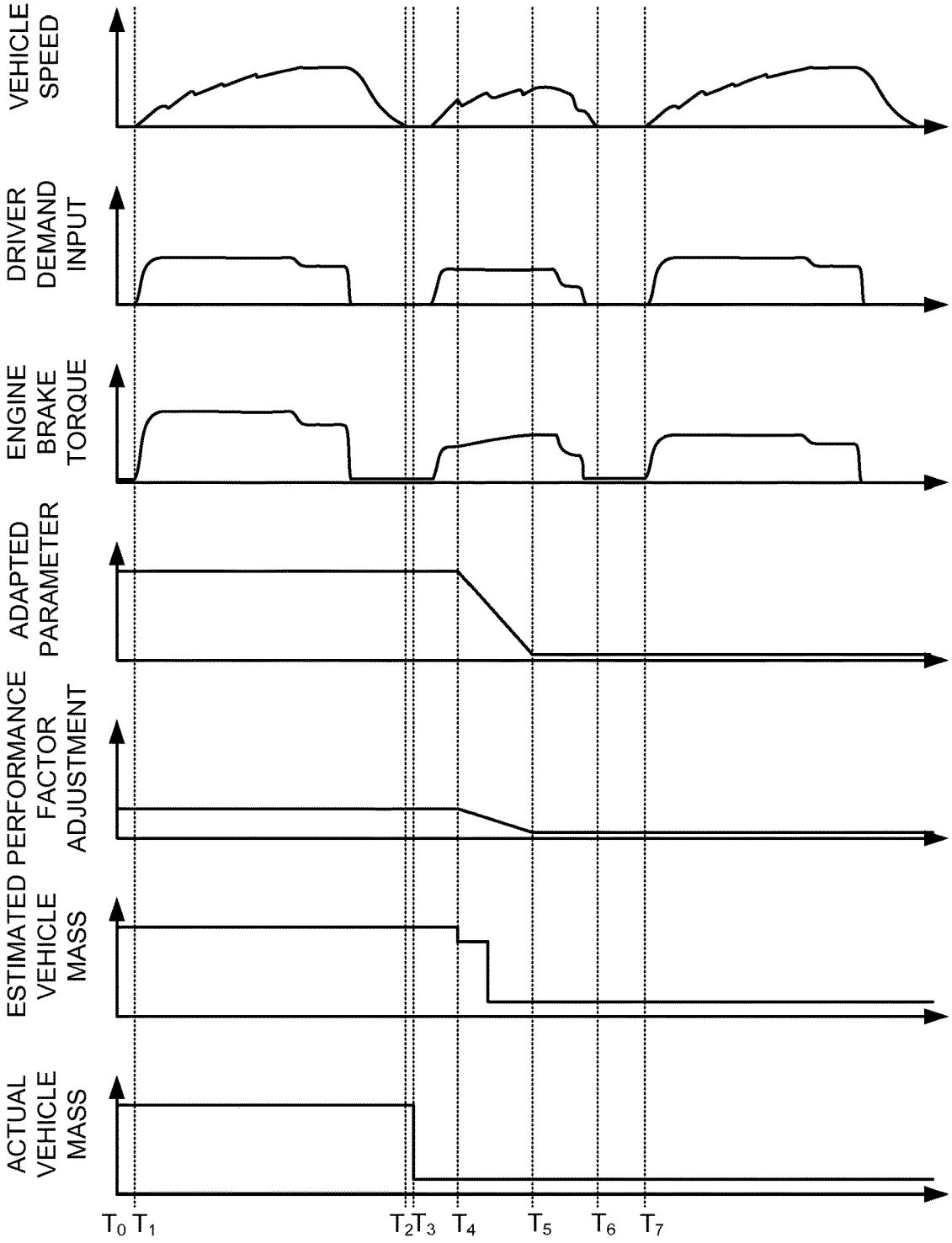
FIG. 3 shows an example vehicle operating sequence according to the methods described herein.

The present description is related to improving operation of a vehicle that may operate over a wide range of vehicle weights. FIG. 1 shows one example of a boosted diesel engine where the method of FIGS. 4-8 may adjust engine operation to equalize vehicle performance in the presence of varying vehicle load. FIG. 3 shows an example simulated vehicle operating sequence where the methods described herein improve vehicle fuel economy at lower vehicle loads and equalize vehicle performance between low and high vehicle loads.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57.

Fuel injector 66 is shown positioned to inject fuel directly into combustion chamber 30, which is known to those skilled in the art as direct injection. Fuel injector 66 delivers fuel in proportion to the pulse width of signal FPW from controller 12.

Intake manifold 44 is shown communicating with optional electronic throttle 62 which adjusts a position of throttle plate 64 to control air flow from intake boost chamber 46. Compressor 162 draws air from air intake 42 to supply boost chamber 46. Exhaust gases spin turbine 164 which is coupled to compressor 162 via shaft 161. In some examples, a charge air cooler may be provided. Compressor speed may be adjusted via adjusting a position of variable vane control 72 or compressor bypass valve 158. In alternative examples, a waste gate 74 may replace or be used in addition to variable vane control 72. Variable vane control 72 adjusts a position of variable geometry turbine vanes. Exhaust gases can pass through turbine 164 supplying little energy to rotate turbine 164 when vanes are in an open position. Exhaust gases can pass through turbine 164 and impart increased force on turbine 164 when vanes are in a closed position. Alternatively, wastegate 74 allows exhaust gases to flow around turbine 164 so as to reduce the amount of energy supplied to the turbine. Compressor bypass valve 158 allows compressed air at the outlet of compressor 162 to be returned to the input of compressor 162. In this way, the efficiency of compressor 162 may be reduced so as to affect the flow of compressor 162 and reduce the possibility of compressor surge.

Combustion is initiated in combustion chamber 30 when fuel ignites as piston 36 approaches top-dead-center compression stroke. In some examples, a universal Exhaust Gas Oxygen (UEGO) sensor 126 may be coupled to exhaust manifold 48 upstream of emissions device 70. In other examples, the UEGO sensor may be located downstream of one or more exhaust after treatment devices. Further, in some examples, the UEGO sensor may be replaced by a NOx sensor that has both NOx and oxygen sensing elements.

At lower engine temperatures glow plug 68 may convert electrical energy into thermal energy so as to raise a temperature in combustion chamber 30. By raising temperature of combustion chamber 30, it may be easier to ignite a cylinder air-fuel mixture via compression.

Emissions device 70 can include a particulate filter and catalyst bricks, in one example. In another example, multiple emission control devices, each with multiple bricks, can be used. Emissions device 70 can include an oxidation catalyst in one example. In other examples, the emissions device may include a lean NOx trap or a selective catalyst reduction (SCR), and/or a diesel particulate filter (DPF).

In examples where engine 10 is a gasoline engine, 66 may be a spark plug and 68 may be a fuel injector. Both fuel injection timing and spark timing may be adjusted with respect to a position of crankshaft 40.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing accelerator position adjusted by foot 132; a measurement of engine manifold pressure (MAP) from pressure sensor 121 coupled to intake manifold 44; boost pressure from pressure sensor 122 exhaust gas oxygen concentration from oxygen sensor 126; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure sensor 135 indicates ambient barometric pressure to controller 12. In a preferred aspect of the present description, engine position sensor 118 produces a predetermined number of equally spaced pulses every revolution of the crankshaft from which engine speed (RPM) can be determined.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In some examples, fuel may be injected to a cylinder a plurality of times during a single cylinder cycle. In a process hereinafter referred to as ignition, the injected fuel is ignited by compression ignition resulting in combustion. Alternatively, combustion may be initiated via a spark produced at a spark plug. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is described merely as an example, and that intake and exhaust valve opening and/or closing timings may vary, such as to provide positive or negative valve overlap, late intake valve closing, or various other examples. Further, in some examples a two-stroke cycle may be used rather than a four-stroke cycle.

Figure 2:
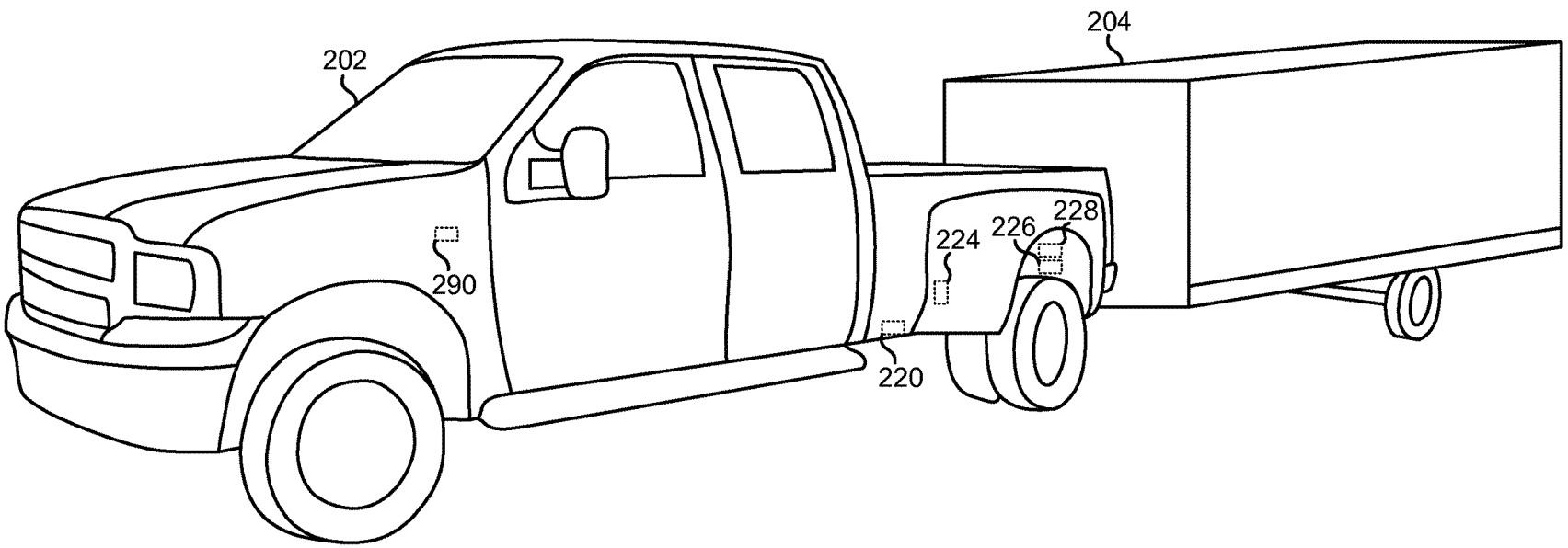
FIG. 2 shows a vehicle in which the engine may operate.

Referring now to FIG. 2, a vehicle in which engine 10 may operate is shown. Vehicle 202 is shown coupled to trailer 204. Vehicle 202 may include a brake proportioning valve 220, vehicle height sensor 224, accelerometer 226, and trailer hitch mounted strain gauge 228. Gross vehicle weight may include the weight of trailer 204 and GVW may be determined via height sensor 224, brake proportioning valve 220, and/or accelerometer. In one example, the output of height sensor 224 is input to a transfer function that outputs vehicle weight as a function of height sensor 224 output. The weight of trailer 204 may be determined via strain gauge 228 during vehicle acceleration. Vehicle 202 may also include and inclinometer 290 for determining road grade.

Thus, the system of FIGS. 1 and 2 provides for an engine system, comprising: an engine; a turbocharger coupled to the engine; and a controller including instructions stored in a non-transitory medium to adjust a driver input variable and an actuator in response to a vehicle launch metric being greater than a threshold value that is based on a gross vehicle weight. The engine system further comprises resetting a parameter immediately to a base value in response to the vehicle launch metric being less than a first threshold value. The engine system further comprising adjusting the parameter at a predetermined rate in response to the vehicle launch metric being greater than a second threshold value. The engine system where the actuator is a turbocharger waste gate, and where exhaust pressure is reduced in response to the vehicle launch metric being greater than the threshold value. The engine system includes where the actuator is a valve timing actuator, and where the valve timing actuator is adjusted to reduce vehicle acceleration to less than a vehicle acceleration described by the vehicle launch metric.

Referring now to FIG. 3, signals of interest during an example time when a vehicle is operated at its GVW and then at lower weight. The signals and sequences of FIG. 3 may be provided by the system shown in FIGS. 1 and 2 executing the method of FIGS. 4-8. Further, the adaptive parameters and vehicle mass change are shown for illustrative purposes and are not intended to limit the scope or breadth of the description. Vertical markers $T_0$-$T_7$ represent times of particular interest in the sequence.

The first plot from the top of FIG. 3 represents vehicle speed versus time. The X represents time and time increases from the left to right side of the figure. The Y axis represents vehicle speed and vehicle speed increases in the direction of the Y axis arrow.

The second plot from the top of FIG. 3 represents driver demand input (e.g., application of an accelerator pedal) versus time. The Y axis represents driver demand input and driver demand input increases in the direction of the Y axis arrow. The X axis represents time and time increases in the direction of the X axis arrow.

The third plot from the top of FIG. 3 represents engine brake torque versus time. The Y axis represents engine brake torque and brake torque increases in the direction of the Y axis arrow. The X axis represents time and time increases in the direction of the X axis arrow.

The fourth plot from the top of FIG. 3 represents a value of an adapted parameter, such as a value in a transfer function, versus time. The value of the adapted parameter increases in the direction of the Y axis arrow. The X axis represents time and time increases from the left to the right side of the figure.

The fifth figure from the top of FIG. 3 represents an engine performance factor versus time. The Y axis represents the engine performance factor and the engine performance factor increases in the direction of the Y axis arrow. The X axis represents time and time increases from the left to the right side of the figure.

The sixth figure from the top of FIG. 3 represents estimated vehicle mass, which may include a trailer, versus time. The Y axis represents estimated vehicle mass and estimated vehicle mass increases in the direction of the Y axis arrow. The X axis represents time and time increases from the left to the right side of the figure.

The seventh figure from the top of FIG. 3 represents actual vehicle mass versus time. The Y axis represents actual vehicle mass versus time and vehicle mass increases in the direction of the Y axis arrow. The X axis represents time and time increases from the left to the right side of the figure.

At time $T_0$, the vehicle mass is at the vehicle's GVW and the vehicle is stopped. The engine is operating at a low brake torque level and the driver demand input is at zero. The adaptive parameter and the performance factor are at low levels indicating no adaption of the adaptive parameter and the performance factor. The estimated vehicle mass is at the GVW.

At the time between $T_0$ and $T_1$, the driver demand input increases in response to driver input and the engine brake torque increases in response to the increased driver input. The vehicle accelerates in response to the engine brake torque and the adapted parameter and the performance factor remain unchanged since the vehicle is being operated at the GVW.

At time $T_2$, the vehicle is stopped after the driver demand has returned to zero in response to driver input and after the engine brake torque has been reduced. The adapted parameter and the performance factor remain unchanged. The estimated vehicle mass and the actual vehicle mass remain at the vehicle's GVW.

At time $T_3$, the actual vehicle mass is changed. The actual vehicle mass may change in response to coupling/decoupling a trailer to the vehicle, adding/removing cargo to the vehicle, and/or adding/removing passengers to or from the vehicle. In this example, the actual vehicle mass is reduced from the GVW by the driver removing cargo from the vehicle. The estimated vehicle mass is not changed in this example until the vehicle begins to move. However, in some examples, estimated vehicle mass may change as soon as cargo or a trailer is removed from the vehicle. For example, the vehicle mass estimate may be changed when the height of the vehicle changes.

Between time $T_3$ and $T_4$, the driver demand input increases in response to driver input. The engine brake torque increases in response to the increasing driver input and the vehicle begins to accelerate at a rate that is greater than the rate at time $T_1$ even though the driver demand input is reduced. The vehicle accelerates at a higher rate because of the lower vehicle mass. The estimated vehicle mass remains constant and the adapted parameter and the performance factor remain constant.

At time $T_4$, the estimated vehicle mass is reduced in response to the increased rate of vehicle acceleration. The performance factor begins to be reduced as is the adapted parameter in response to the reduced vehicle mass.

Between time $T_4$ and time $T_5$, the vehicle mass estimate is further reduced and the adapted parameter and the performance factor continue to be adjusted. In this example, the vehicle mass is reduced in response to an estimate of vehicle mass that is based on vehicle acceleration and estimated engine brake torque.

At time $T_5$, the vehicle mass estimate arrives at the final vehicle mass and the adapted parameter as well as the performance factor adjustment complete the adaptation process and arrive at a constant value or static function. The vehicle acceleration is reduced as compared to the vehicle acceleration at time $T_4$ because the vehicle is in a higher gear and because the adapted parameter adjusts the effect that the driver demand input has on engine brake torque. The actual vehicle mass remains constant since the vehicle continues to carry the same load as at time $T_3$.

At time $T_6$, the vehicle comes to a stop in response to the driver demand input and the engine brake torque being reduced before time $T_6$. The vehicle mass is less than the GVW, and the estimated vehicle mass is constant. The performance factor and the adapted parameter also remain at constant values.

At time $T_7$ the driver demand input changes identically to the driver demand input at time $T_1$. However, the vehicle mass at time $T_7$ is reduced as compared to the vehicle mass at time $T_1$. Nevertheless, the vehicle accelerates at the same rate as shown at time $T_1$ because the adapted parameter causes the engine brake torque to be reduced as compared to the engine brake torque at time $T_1$. Further, the performance adjustment factor causes exhaust pressure at the turbine to be reduced so that engine pumping work may be reduced so that engine fuel economy may be increased. Alternatively, the performance adjustment factor may modify engine intake and/or exhaust valve timing. In this way, the adapted parameter and performance factor may be adjusted in response to a decrease in vehicle weight from a GVW.

Figure 4:
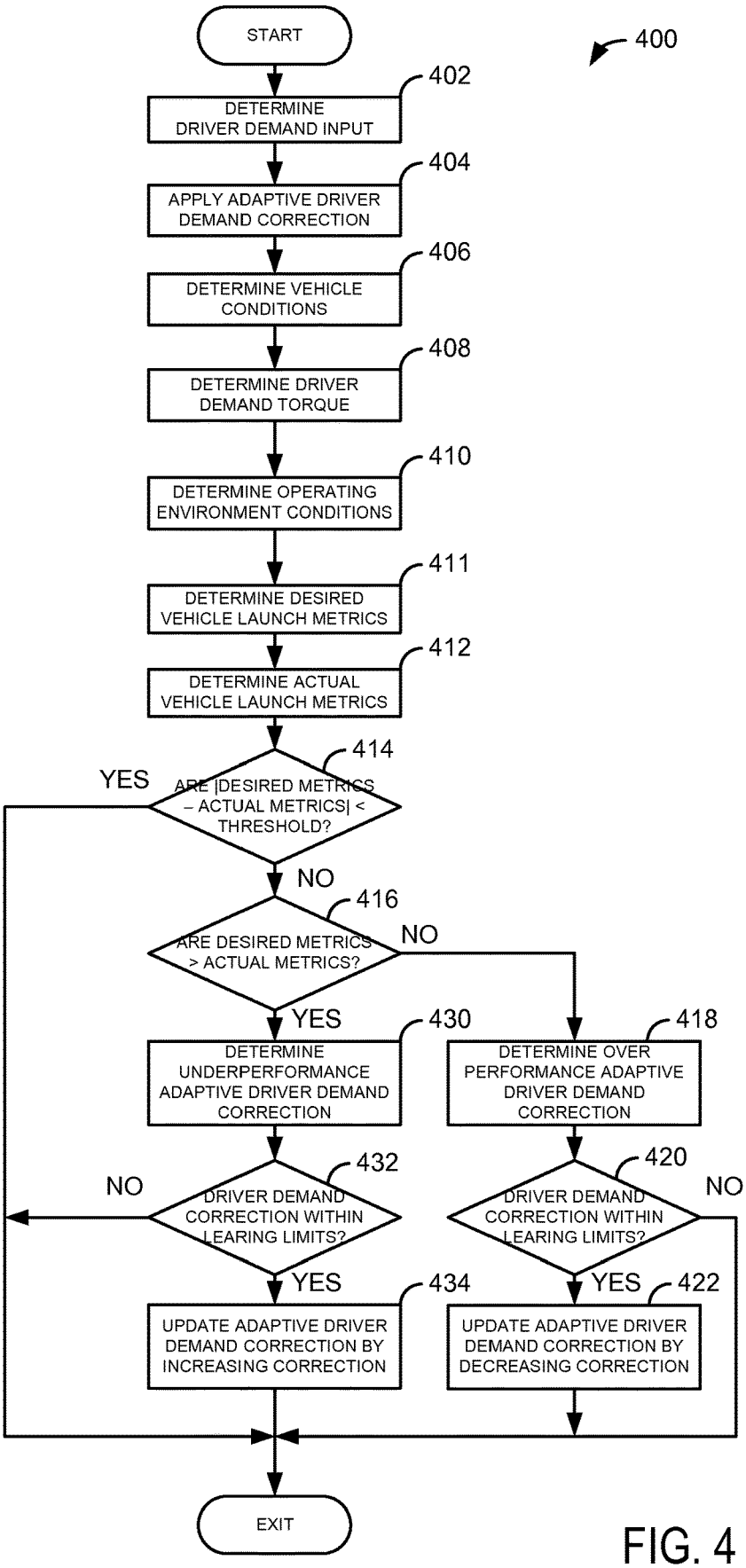
FIGS. 4-8 show example methods for operating a vehicle and improving vehicle performance.

Referring now to FIG. 4 a first method for operating a vehicle and improving vehicle performance is shown. The method of FIG. 4 may provide the sequence illustrated in FIG. 3.

At 402, method 400 determines a driver input demand. The driver demand input may be received from an accelerator pedal, lever, or another device. In one example, the driver demand input converts a driver's foot rotation in to a voltage. Method 400 proceeds to 404 after the driver demand input is determined.

At 404, an adaptive driver demand correction is applied to the driver demand input. The adaptive driver demand correction in this example is a term that varies with vehicle mass. The adaptive driver demand is added to the driver input demand to adjust operation of the engine. In one example, the adaptive driver demand has a value of zero when the vehicle mass is at the GVW. If vehicle mass is decreased, the adaptive driver demand may be increased or decreased based on the particular implementation. In one example, the adaptive driver demand is decreased when vehicle mass decreases so that the driver demand input value is reduced. A driver demand lower limit of zero may also be applied. For example, if the driver demand input is 2.5 volts at a particular accelerator pedal position and the adaptive driver demand correction is 0.05 volts, the corrected driver demand input is 2.45 volts. Method 400 proceeds to 406 after the adaptive driver demand correction is applied.

At 406, vehicle conditions are determined. Vehicle conditions may include but are not limited to engine speed, vehicle speed, engine load, transmission gear, and engine temperature. Method 400 proceeds to 408 after vehicle conditions are determined.

At 408, method 400 determines driver demand torque. In one example, driver demand torque is determined via indexing a transfer function that is stored in memory using the adjusted driver demand input (e.g., the driver demand input plus the adaptive driver demand correction). The transfer function outputs an engine brake torque, desired wheel torque, torque converter impeller torque or other driveline torque. The transfer function output may be further adjusted based on vehicle conditions. For example, the driver demand torque may be reduced for lower engine temperatures. Method 400 proceeds to 410 after driver demand torque is determined.

At 410, method 400 determines operating environmental conditions. Environmental conditions may include but are not limited to barometric pressure, road grade, and ambient temperature. Method 400 proceeds to 411 after determining environmental conditions.

At 411, method 400 determines desired vehicle launch metrics. In one example, vehicle launch metrics are stored in a table or function that outputs an empirically determined vehicle acceleration rate based on vehicle weight, barometric pressure, present transmission gear, and driver demand torque. Method 400 transitions through the table or function outputting new values as driver demand torque and other parameters vary. Further, in one example, the vehicle launch metrics are based on the vehicle operating at the GVW and providing a desired rate of acceleration at a desired engine emissions output level. Method 400 proceeds to 412 after desired vehicle launch metrics are determined.

At 412, method 400 determines actual vehicle launch metrics. In one example, vehicle acceleration from vehicle stop to a threshold speed may be determined from a vehicle speed sensor. For example, a vehicle acceleration rate may be determined at predetermined times or predetermined vehicle travel distances after the vehicle brake is released and the vehicle begins to move. Method 400 proceeds to 414 after actual vehicle launch metrics are determined.

At 414, method 400 judges whether or not the absolute value of the desired vehicle launch metrics minus the actual vehicle launch metrics is less than a threshold value. For example, method 400 may determine an actual acceleration rate of X $Km/sec^2$ and a desired acceleration of Y $Km/sec^2$. If the difference is less than a threshold acceleration rate, the answer is yes and method 400 proceeds to exit. Otherwise, the answer is no and method 400 proceeds to 416.

At 416, method 400 judges whether or not the desired launch metrics are greater than the actual launch metrics. If so, the answer is yes and method 400 proceeds to 430. Otherwise, the answer is no and method 400 proceeds to 418. In some examples, two thresholds may be provided instead of the single desired launch metric. For example, if the actual launch metric is greater than a first threshold, method 400 proceeds to 430. On the other hand, if the actual launch metric is less than a second threshold, method 400 proceeds to 418. Further, the adaptive driver demand may be reset to a predetermined value such as zero or one in response to the launch metric being less than the second threshold.

At 418, method 400 determines an over performance adaptive driver demand correction. The over performance adaptive driver demand correction may reduce engine brake torque for prescribed driver input so that the vehicle does not accelerate at a rate that is greater than the rate the vehicle accelerates at similar conditions when the vehicle weight is at the GVW. In one example, the over performance adaptive driver demand may be extracted from a table or function of empirically determined over performance adaptive driver demand corrections. In other examples, the over performance adaptive driver demand correction may be based on the difference between the desired launch metrics and the actual launch metrics multiplied by a predetermined factor. Method 400 proceeds to 420 after the over performance adaptive driver demand correction is determined.

At 420, method 400 judges whether or not the over performance adaptive driver demand correction is within predetermined learning limits. For example, the over performance adaptive driver demand correction may be judged to be within a range of values. If method 400 judges that the over performance driver demand correction is within learning limits the answer is yes and method 400 proceeds to 422. Otherwise, method 400 proceeds to exit and the adaptive driver demand correction is not updated.

At 422, method 400 updates the adaptive driver demand correction by decreasing the adaptive driver demand correction used at 404. In particular, the adaptive driver demand correction value applied at 404 is reduced by the over performance adaptive driver demand correction determined at 418. In this way, the adaptive driver demand correction may be adapted to account for conditions when the vehicle is not operated at the GVW. By basing vehicle launch metrics on the vehicle operating at the GVW it may be possible to provide more consistent vehicle performance when the vehicle is operated over a wide range of vehicle weight. In some examples, the adaptation may occur during vehicle acceleration, but application of the adapted values may be delayed until after a throttle tip-out so that the driver does not experience a torque disturbance. In other examples, the adaptation may occur during vehicle acceleration, but the accelerator pedal may be required to return to a base position before the adapted values may be applied. In this way, a value of a transfer function may be adapted before a driver input device is operated at a position that corresponds to the adapted value. Further, the values of a transfer function may be adjusted in increments less than a first value when the driver input device is applied in an amount greater than a first threshold value, and where values of the transfer function are adjusted in increments greater than the first value when the driver input device is applied in an amount less than the first threshold value.

At 430, method 400 determines an underperformance adaptive driver demand correction. The underperformance adaptive driver demand correction may increase engine brake torque for prescribed driver input so that the vehicle accelerates at a rate that is greater than the rate the vehicle accelerated using the present value of the adaptive driver demand correction. In one example, the underperformance adaptive driver demand may be extracted from a table or function of empirically determined underperformance adaptive driver demand corrections. In other examples, the underperformance adaptive driver demand correction may be based on the difference between the desired launch metrics and the actual launch metrics multiplied by a predetermined factor. Method 400 proceeds to 432 after the underperformance adaptive driver demand correction is determined.

At 432, method 400 judges whether or not the underperformance adaptive driver demand correction is within predetermined learning limits. For example, the underperformance adaptive driver demand correction may be judged to be within a range of values. If method 400 judges that the underperformance driver demand correction is within learning limits the answer is yes and method 400 proceeds to 434. Otherwise, method 400 proceeds to exit and the adaptive driver demand correction is not updated.

At 434, method 400 updates the adaptive driver demand correction by increasing the adaptive driver demand correction used at 404. In particular, the adaptive driver demand correction value applied at 404 is increased by the underperformance adaptive driver demand correction determined at 430. In this way, the adaptive driver demand correction may be adapted to account for conditions when the vehicle is not operated at the GVW.

Figure 5:
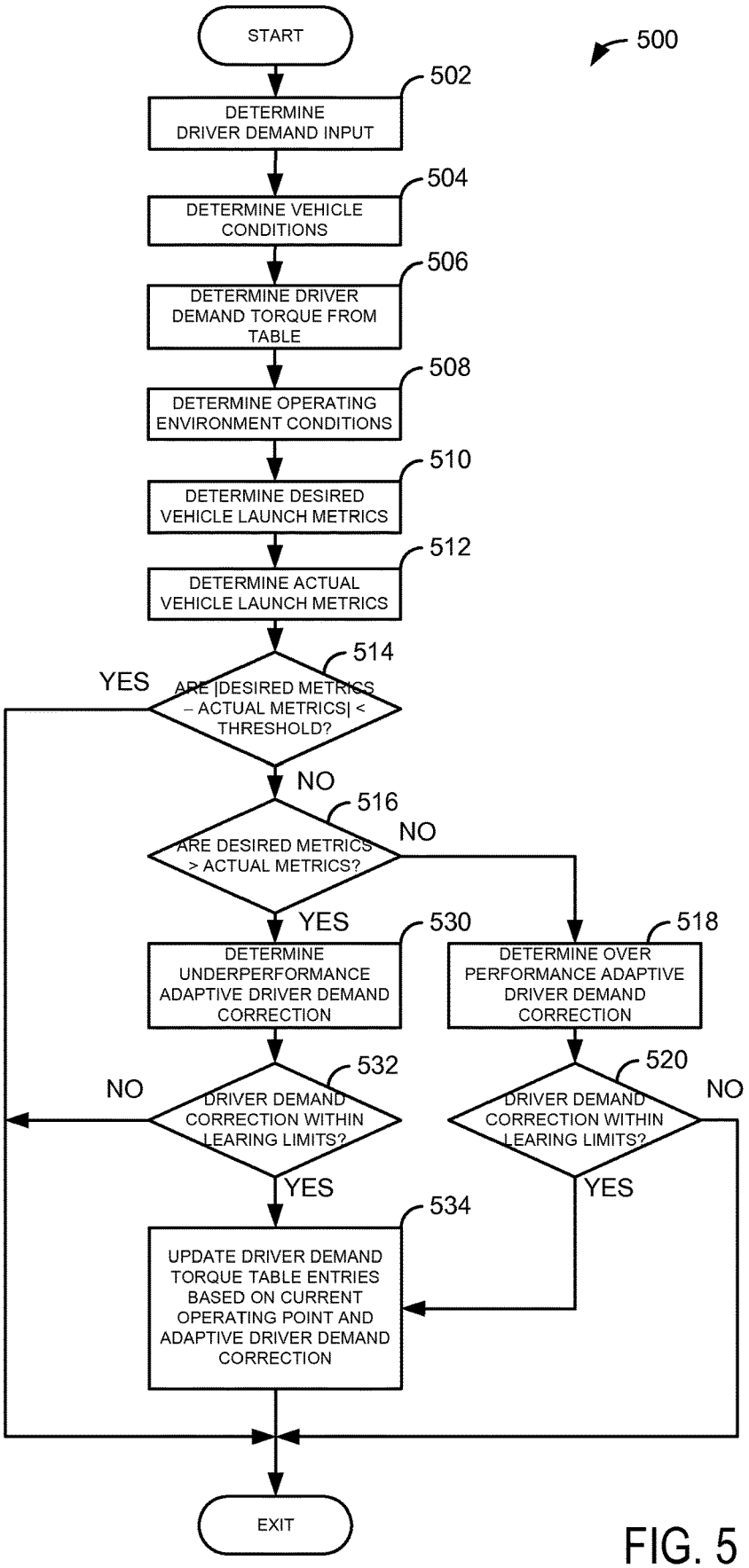

Referring now to FIG. 5, a second method for operating a vehicle and improving vehicle performance is shown. The method of FIG. 5 may provide the sequence illustrated in FIG. 3.

At 502, method 500 determines a driver input demand. The driver demand input may be received from an accelerator pedal, lever, or another device. In one example, the driver demand input converts a driver's foot rotation in to a voltage. Method 500 proceeds to 504 after the driver demand input is determined.

At 504, vehicle conditions are determined. Vehicle conditions may include but are not limited to engine speed, vehicle speed, engine load, transmission gear, and engine temperature. Method 500 proceeds to 506 after vehicle conditions are determined.

At 506, method 500 determines driver demand torque from a table. In one example, driver demand torque is determined via indexing a table that is stored in memory. The table may be indexed using the driver demand input. The table may have entries that represent a transfer function, and the transfer function outputs an engine brake torque, desired wheel torque, torque converter impeller torque or other driveline torque. The transfer function output may be further adjusted based on vehicle conditions. For example, the driver demand torque may be reduced for lower engine temperatures. Method 500 proceeds to 508 after driver demand torque is determined.

At 508, method 500 determines operating environmental conditions. Environmental conditions may include but are not limited to barometric pressure, road grade, and ambient temperature. Method 500 proceeds to 510 after determining environmental conditions.

At 510, method 500 determines desired vehicle launch metrics. Desired vehicle launch metrics may be determined as described at 411 of FIG. 4. Method 500 proceeds to 512 after desired vehicle launch metrics are determined.

At 512, method 500 determines actual vehicle launch metrics. Actual vehicle launch metrics may be determined as described at 412 of FIG. 4. Method 500 proceeds to 514 after actual vehicle launch metrics are determined.

At 514, method 500 judges whether or not the absolute value of the desired vehicle launch metrics minus the actual vehicle launch metrics is less than a threshold value. If the difference is less than a threshold acceleration rate, the answer is yes and method 500 proceeds to exit. Otherwise, the answer is no and method 500 proceeds to 516.

At 516, method 500 judges whether or not the desired launch metrics are greater than the actual launch metrics. If so, the answer is yes and method 500 proceeds to 530. Otherwise, the answer is no and method 500 proceeds to 518.

At 518, method 500 determines an over performance adaptive driver demand correction. The over performance adaptive driver demand correction may reduce engine brake torque for prescribed driver input so that the vehicle does not accelerate at a rate that is greater than the rate the vehicle accelerates at similar conditions when the vehicle weight is at the GVW. In one example, the over performance adaptive driver demand may be extracted from a table or function of empirically determined over performance adaptive driver demand corrections. In other examples, the over performance adaptive driver demand correction may be based on the difference between the desired launch metrics and the actual launch metrics multiplied by a predetermined factor. Method 500 proceeds to 520 after the over performance adaptive driver demand correction is determined.

At 520, method 500 judges whether or not the over performance adaptive driver demand correction is within predetermined learning limits. For example, the over performance adaptive driver demand correction may be judged to be within a range of values. If method 500 judges that the over performance driver demand correction is within learning limits the answer is yes and method 500 proceeds to 534. Otherwise, method 500 proceeds to exit and the adaptive driver demand correction is not updated.

At 534, method 500 updates the driver demand torque table entries base on the present engine and vehicle operating conditions and the adaptive driver demand correction from under performance block 530 or over performance block 518. In particular, values stored in cells of the drive demand torque table may be increased or decreased in an amount based on the output of 518 or 530. Alternatively, a value determined at 530 for 518 may directly replace a value stored in a table cell. In this way, the driver demand torque table may be corrected to account for conditions when the vehicle is not operated at the GVW. By basing vehicle launch metrics on the vehicle operating at the GVW it may be possible to provide more consistent vehicle performance when the vehicle is operated over a wide range of vehicle weight.

At 530, method 500 determines an underperformance adaptive driver demand correction. The underperformance adaptive driver demand correction may increase engine brake torque for prescribed driver input so that the vehicle accelerates at a rate that is greater than the rate the vehicle accelerated using the present value of the adaptive driver demand correction. In one example, the underperformance adaptive driver demand may be extracted from a table or function of empirically determined underperformance adaptive driver demand corrections. In other examples, the underperformance adaptive driver demand correction may be based on the difference between the desired launch metrics and the actual launch metrics multiplied by a predetermined factor. Method 500 proceeds to 532 after the underperformance adaptive driver demand correction is determined.

At 532, method 500 judges whether or not the underperformance adaptive driver demand correction is within predetermined learning limits. For example, the underperformance adaptive driver demand correction may be judged to be within a range of values. If method 500 judges that the underperformance driver demand correction is within learning limits the answer is yes and method 500 proceeds to 534. Otherwise, method 500 proceeds to exit and the adaptive driver demand correction is not updated.

Figure 6:
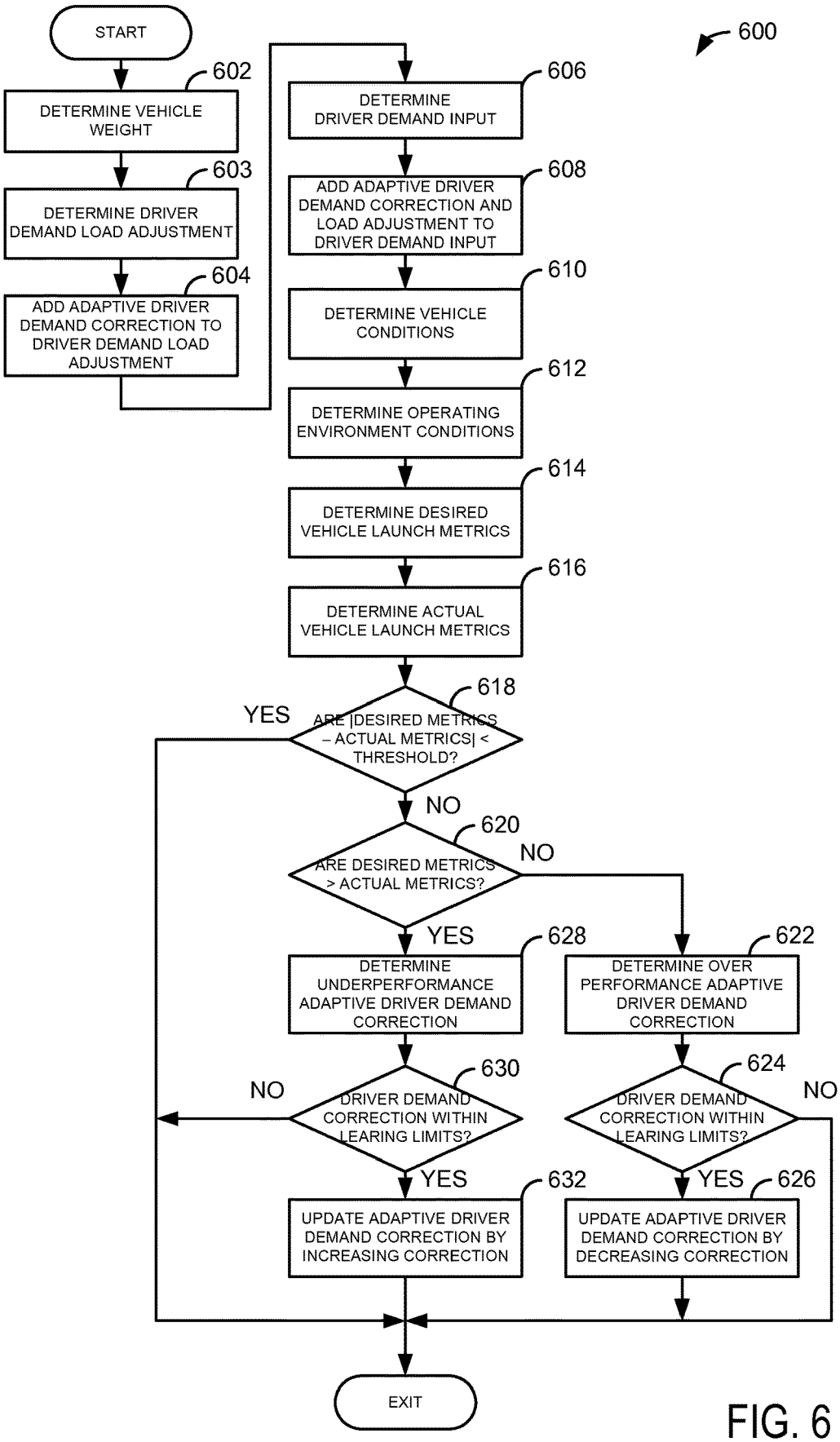

Referring now to FIG. 6 a third method for operating a vehicle and improving vehicle performance is shown. The method of FIG. 6 may provide the sequence illustrated in FIG. 3.

At 602, method 600 determines vehicle weight or mass. Vehicle weight may be determined via a vehicle height sensor, a vehicle accelerometer, inferred from vehicle acceleration and engine brake torque, or based on a brake proportioning valve output. Vehicle weight may include weight of a trailer coupled to the vehicle. In some examples the adaptive driver demand correction may be reset to zero so that the engine operates without adjusting the driver demand input when the vehicle is determined to be operating at the GVW. Method 600 proceeds to 603 after vehicle weight or mass is determined.

At 603, method 600 determines a driver demand load adjustment as a function of vehicle load or weight. In one example, a function of empirically determined driver demand load adjustment values are indexed according to the determined vehicle weight and the function outputs a driver demand load adjustment. Method 600 proceeds to 604 after the driver demand load adjustment is determined.

At 604, method 600 adds an adaptive driver demand correction to the driver demand load adjustment. The driver demand correction may be determined as described at 632 and 626. In some examples, the driver demand correction may be in the form of a transfer function and it may be stored in an array in controller memory. Method 600 proceeds to 606 after the adaptive driver demand correction is added to the driver demand load adjustment.

At 606, method 600 determines a driver input demand. The driver demand input may be received from an accelerator pedal, lever, or another device. In one example, the driver demand input converts a driver's foot rotation in to a voltage. Method 600 proceeds to 608 after the driver demand input is determined.

At 608, method 600 adds the sum of adaptive driver demand correction and driver demand load adjustment to the driver demand input. In this way, the driver demand input is adjusted to alter engine behavior. Method 600 proceeds to 610 after the driver demand input is revised.

At 610, vehicle conditions are determined. Vehicle conditions may include but are not limited to engine speed, vehicle speed, engine load, transmission gear, and engine temperature. Method 600 proceeds to 612 after vehicle conditions are determined.

At 612, method 600 determines operating environmental conditions. Environmental conditions may include but are not limited to barometric pressure, road grade, and ambient temperature. The environmental conditions may further adjust the driver demand correction. For example, the adaptive driver demand correction may be multiplied by a factor that is expressed as present barometric pressure divided by a nominal barometric pressure when barometric pressure changes. Method 600 proceeds to 614 after determining environmental conditions.

At 614, method 600 determines desired vehicle launch metrics. Desired vehicle launch metrics may be determined as described at 411 of FIG. 4. Method 600 proceeds to 616 after desired vehicle launch metrics are determined.

At 616, method 600 determines actual vehicle launch metrics. Actual vehicle launch metrics may be determined as described at 412 of FIG. 4. Method 600 proceeds to 618 after actual vehicle launch metrics are determined.

At 618, method 600 judges whether or not the absolute value of the desired vehicle launch metrics minus the actual vehicle launch metrics is less than a threshold value. If the difference is less than a threshold acceleration rate, the answer is yes and method 600 proceeds to exit. Otherwise, the answer is no and method 600 proceeds to 620.

At 620, method 600 judges whether or not the desired launch metrics are greater than the actual launch metrics. If so, the answer is yes and method 600 proceeds to 628. Otherwise, the answer is no and method 600 proceeds to 622.

At 622, method 600 determines an over performance adaptive driver demand correction. The over performance adaptive driver demand correction may reduce engine brake torque for prescribed driver input so that the vehicle does not accelerate at a rate that is greater than the rate the vehicle accelerates at similar conditions when the vehicle weight is at the GVW. In one example, the over performance adaptive driver demand may be extracted from a table or function of empirically determined over performance adaptive driver demand corrections. In other examples, the over performance adaptive driver demand correction may be based on the difference between the desired launch metrics and the actual launch metrics multiplied by a predetermined factor. Method 600 proceeds to 624 after the over performance adaptive driver demand correction is determined.

At 624, method 600 judges whether or not the over performance adaptive driver demand correction is within predetermined learning limits. For example, the over performance adaptive driver demand correction may be judged to be within a range of values. If method 600 judges that the over performance driver demand correction is within learning limits the answer is yes and method 600 proceeds to 626. Otherwise, method 600 proceeds to exit and the adaptive driver demand correction is not updated.

At 626, method 600 updates the adaptive driver demand correction by decreasing the adaptive driver demand correction used at 604. In particular, the adaptive driver demand correction value applied at 604 is reduced by the over performance adaptive driver demand correction determined at 622. In this way, the adaptive driver demand correction may be adapted to account for conditions when the vehicle is not operated at the GVW. By basing vehicle launch metrics on the vehicle operating at the GVW it may be possible to provide more consistent vehicle performance when the vehicle is operated over a wide range of vehicle weight. Further, in some examples, more than a single value of a transfer function may be adapted at one time. For example, if it is determined that a particular transfer function value is to be increased by 2%, all other transfer function values including values that exceed the present value may be increased by 2% also.

At 628, method 600 determines an underperformance adaptive driver demand correction. The underperformance adaptive driver demand correction may increase engine brake torque for prescribed driver input so that the vehicle accelerates at a rate that is greater than the rate the vehicle accelerated using the present value of the adaptive driver demand correction. In one example, the underperformance adaptive driver demand may be extracted from a table or function of empirically determined underperformance adaptive driver demand corrections. In other examples, the underperformance adaptive driver demand correction may be based on the difference between the desired launch metrics and the actual launch metrics multiplied by a predetermined factor. Method 600 proceeds to 630 after the underperformance adaptive driver demand correction is determined.

At 630, method 600 judges whether or not the underperformance adaptive driver demand correction is within predetermined learning limits. For example, the underperformance adaptive driver demand correction may be judged to be within a range of values. If method 600 judges that the underperformance driver demand correction is within learning limits the answer is yes and method 600 proceeds to 632. Otherwise, method 600 proceeds to exit and the adaptive driver demand correction is not updated.

At 632, method 600 updates the adaptive driver demand correction by increasing the adaptive driver demand correction used at 604. In particular, the adaptive driver demand correction value applied at 604 is increased by the underperformance adaptive driver demand correction determined at 628. In this way, the adaptive driver demand correction may be adapted to account for conditions when the vehicle is not operated at the GVW.

Figure 7:
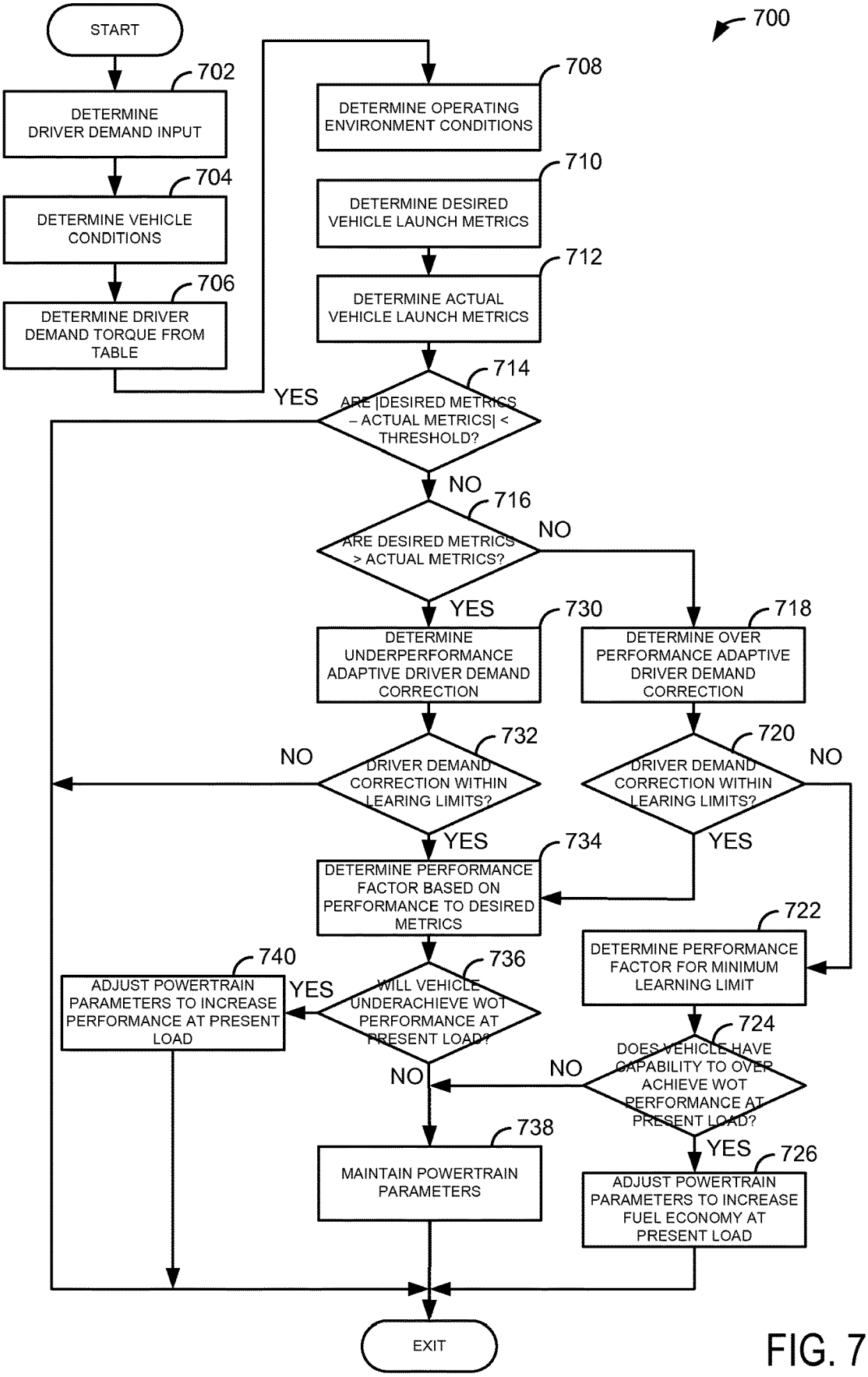

Referring now to FIG. 7 a fourth method for operating a vehicle and improving vehicle performance is shown. The method of FIG. 7 may provide the sequence illustrated in FIG. 3.

At 702, method 700 determines a driver input demand. The driver demand input may be received from an accelerator pedal, lever, or another device. In one example, the driver demand input converts a driver's foot rotation in to a voltage. Method 700 proceeds to 704 after the driver demand input is determined.

At 704, vehicle conditions are determined. Vehicle conditions may include but are not limited to engine speed, vehicle speed, engine load, transmission gear, and engine temperature. Method 700 proceeds to 706 after vehicle conditions are determined.

At 706, method 700 determines driver demand torque from a table. In one example, driver demand torque is determined via indexing a table that is stored in memory. The table may be indexed using the driver demand input. The table may have entries that represent a transfer function, and the transfer function outputs an engine brake torque, desired wheel torque, torque converter impeller torque or other driveline torque. The transfer function output may be further adjusted based on vehicle conditions. For example, the driver demand torque may be reduced for lower engine temperatures. Method 700 proceeds to 708 after driver demand torque is determined.

At 708, method 700 determines operating environmental conditions. Environmental conditions may include but are not limited to barometric pressure, road grade, and ambient temperature. Method 700 proceeds to 710 after determining environmental conditions.

At 710, method 700 determines desired vehicle launch metrics. Desired vehicle launch metrics may be determined as described at 411 of FIG. 4. Method 700 proceeds to 712 after desired vehicle launch metrics are determined.

At 712, method 700 determines actual vehicle launch metrics. Actual vehicle launch metrics may be determined as described at 412 of FIG. 4. Method 700 proceeds to 714 after actual vehicle launch metrics are determined.

At 714, method 700 judges whether or not the absolute value of the desired vehicle launch metrics minus the actual vehicle launch metrics is less than a threshold value. If the difference is less than a threshold acceleration rate, the answer is yes and method 700 proceeds to exit. Otherwise, the answer is no and method 700 proceeds to 716.

At 716, method 700 judges whether or not the desired launch metrics are greater than the actual launch metrics. If so, the answer is yes and method 700 proceeds to 730. Otherwise, the answer is no and method 700 proceeds to 718.

At 718, method 700 determines an over performance adaptive driver demand correction. The over performance adaptive driver demand correction may reduce engine brake torque for prescribed driver input so that the vehicle does not accelerate at a rate that is greater than the rate the vehicle accelerates at similar conditions when the vehicle weight is at the GVW. In one example, the over performance adaptive driver demand may be extracted from a table or function of empirically determined over performance adaptive driver demand corrections. In other examples, the over performance adaptive driver demand correction may be based on the difference between the desired launch metrics and the actual launch metrics multiplied by a predetermined factor. Method 700 proceeds to 720 after the over performance adaptive driver demand correction is determined.

At 720, method 700 judges whether or not the over performance adaptive driver demand correction is within predetermined learning limits. For example, the over performance adaptive driver demand correction may be judged to be within a range of values. If method 700 judges that the over performance driver demand correction is within learning limits the answer is yes and method 700 proceeds to 734. Otherwise, method 700 proceeds to 722.

At 722, method 700 determines a performance factor for a minimum learning limit. In on example, the performance factor is a parameter that adjusts an actuator that affects engine performance so that the vehicle may provide substantially the same performance metric at different vehicle weights. For example, a performance metric that adjusts pressure upstream of a turbocharger turbine may be adjusted so that the vehicle accelerates at substantially the same rate (e.g., within $\pm 0.4$ Km/s$^2$) at the GVW and at 70% of GVW. In some example, a plurality of performance factors may adjust actuators so as to adjust spark timing, fuel injection timing, valve timing, turbine inlet pressure, boost pressure, and EGR flow. In one example, the performance factors are empirically determined and stored in memory. The performance factors may be indexed via vehicle weight or by other variable such as actual performance metrics. The performance factors determined at 722 are based on a minimum driver demand correction. Method 700 proceeds to 724 after the performance factors are determined.

At 724, method 700 judges whether or not the vehicle has a capability to over achieve wide open throttle (WOT) performance at the present vehicle weight. For example, if at WOT, the vehicle accelerates at a rate higher than desired, the vehicle has the capability to over achieve WOT performance. If method 700 judges that the vehicle has the capability to over achieve WOT, the answer is yes and method 700 proceeds to 726. Otherwise, the answer is no and method 700 proceeds to 738.

At 730, method 700 determines an underperformance adaptive driver demand correction. The underperformance adaptive driver demand correction may increase engine brake torque for prescribed driver input so that the vehicle accelerates at a rate that is greater than the rate the vehicle accelerated using the present value of the adaptive driver demand correction. In one example, the underperformance adaptive driver demand may be extracted from a table or function of empirically determined underperformance adaptive driver demand corrections. In other examples, the underperformance adaptive driver demand correction may be based on the difference between the desired launch metrics and the actual launch metrics multiplied by a predetermined factor. Method 700 proceeds to 732 after the underperformance adaptive driver demand correction is determined.

At 732, method 700 judges whether or not the underperformance adaptive driver demand correction is within predetermined learning limits. For example, the underperformance adaptive driver demand correction may be judged to be within a range of values. If method 700 judges that the underperformance driver demand correction is within learning limits the answer is yes and method 700 proceeds to 734. Otherwise, method 700 proceeds to exit and the adaptive driver demand correction is not updated.

At 734, method 700 determines one or more performance factors based on performance to desired metrics. For example, method 700 determines performance factors based on a difference between actual vehicle performance and desired vehicle performance. In one example, vehicle acceleration is the vehicle performance metric. Further, method 700 indexes a function that includes empirically determined performance factors that are extracted based on the difference between the desired performance and the actual performance. For example, the performance factors may adjust valve timing to advance by 5 degrees, reduce turbine inlet pressure, and/or adjust boost pressure. Method 700 proceeds to 736 after the performance factors are determined.

At 736, method 700 judges whether or not the vehicle will underachieve WOT performance objectives at the present vehicle weight or load. In one example, method 700 judges whether or not the vehicle will underachieve WOT performance based on the rate of vehicle acceleration at a prescribed engine load. If method 700 judges that the vehicle will underachieve WOT performance, the answer is yes and method 700 proceeds to 740. Otherwise, the answer is no and method 700 proceeds to 738.

At 738, method 700 maintains powertrain parameters. The powertrains parameters are maintained so as to keep the vehicle performing at its present level. For example, spark timing and fuel injection timing may continue without adjustments.

At 740, method 700 adjusts powertrain parameters to increase engine performance at the present vehicle weight or load. In one example, turbocharger boost pressure may be increased. Further, spark timing may be advanced and fuel injection timing may also be adjusted. Method 700 proceeds to exit after powertrain parameters have been adjusted to increase vehicle and engine performance at the present vehicle weight.

Figure 8:
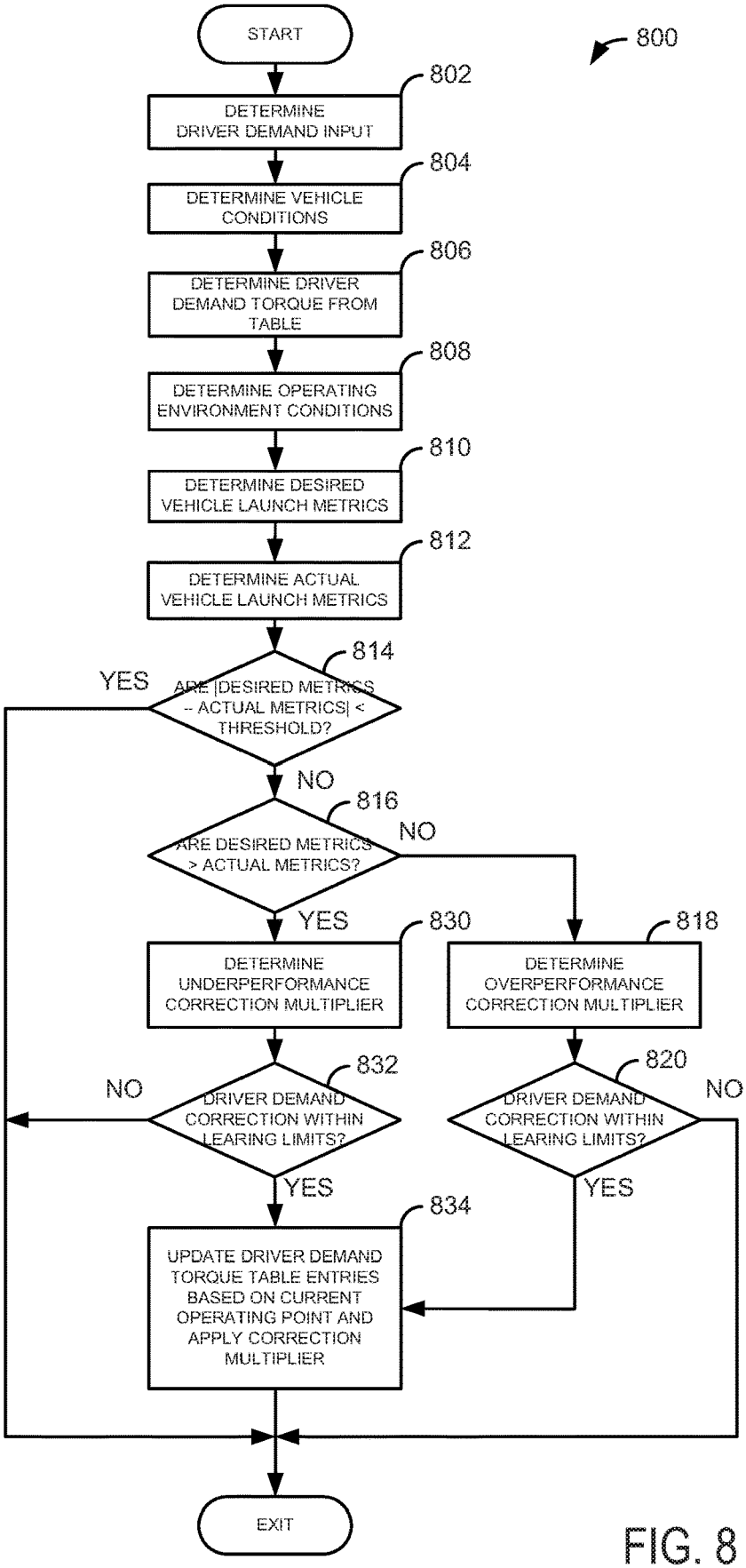

Referring now to FIG. 8, a second method for operating a vehicle and improving vehicle performance is shown. The method of FIG. 8 may provide the sequence illustrated in FIG. 3.

At 802, method 800 determines a driver input demand. The driver demand input may be received from an accelerator pedal, lever, or another device. In one example, the driver demand input converts a driver's foot rotation in to a voltage. Method 800 proceeds to 804 after the driver demand input is determined.

At 804, vehicle conditions are determined. Vehicle conditions may include but are not limited to engine speed, vehicle speed, engine load, transmission gear, and engine temperature. Method 800 proceeds to 806 after vehicle conditions are determined.

At 806, method 800 determines driver demand torque from a table. In one example, driver demand torque is determined via indexing a table that is stored in memory. The table may be indexed using the driver demand input. The table may have entries that represent a transfer function, and the transfer function outputs an engine brake torque, desired wheel torque, torque converter impeller torque or other driveline torque. The transfer function output may be further adjusted based on vehicle conditions. For example, the driver demand torque may be reduced for lower engine temperatures. Method 800 proceeds to 808 after driver demand torque is determined.

At 808, method 800 determines operating environmental conditions. Environmental conditions may include but are not limited to barometric pressure, road grade, and ambient temperature. Method 800 proceeds to 810 after determining environmental conditions.

At 810, method 800 determines desired vehicle launch metrics. Desired vehicle launch metrics may be determined as described at 411 of FIG. 4. Method 800 proceeds to 812 after desired vehicle launch metrics are determined.

At 812, method 800 determines actual vehicle launch metrics. Actual vehicle launch metrics may be determined as described at 412 of FIG. 4. Method 800 proceeds to 814 after actual vehicle launch metrics are determined.

At 814, method 800 judges whether or not the absolute value of the desired vehicle launch metrics minus the actual vehicle launch metrics is less than a threshold value. If the difference is less than a threshold acceleration rate, the answer is yes and method 800 proceeds to exit. Otherwise, the answer is no and method 800 proceeds to 816.

At 816, method 800 judges whether or not the desired launch metrics are greater than the actual launch metrics. If so, the answer is yes and method 800 proceeds to 830. Otherwise, the answer is no and method 800 proceeds to 818.

At 818, method 800 determines an over performance adaptive driver demand correction multiplier. The over performance adaptive driver demand correction multiplier may reduce engine brake torque for prescribed driver input so that the vehicle does not accelerate at a rate that is greater than the rate the vehicle accelerates at similar conditions when the vehicle weight is at the GVW. In one example, the over performance adaptive driver demand multiplier may be extracted from a table or function of empirically determined over performance adaptive driver demand corrections. In other examples, the over performance adaptive driver demand correction multiplier may be based on the difference between the desired launch metrics and the actual launch metrics multiplied by a predetermined factor. Method 800 proceeds to 820 after the over performance adaptive driver demand correction multiplier is determined.

At 820, method 800 judges whether or not the over performance adaptive driver demand correction is within predetermined learning limits. For example, the over performance adaptive driver demand correction may be judged to be within a range of values. If method 800 judges that the over performance driver demand correction is within learning limits the answer is yes and method 800 proceeds to 834. Otherwise, method 800 proceeds to exit and the adaptive driver demand correction is not updated.

At 834, method 1800 updates the driver demand torque table entries base on the present engine and vehicle operating conditions and the adaptive driver demand correction multiplier from under performance block 830 or over performance block 818. In particular, values stored in cells of the drive demand torque table may be increased or decreased in an amount based multiplying the table entry by the output of 818 or 830. In this way, the driver demand torque table may be corrected to account for conditions when the vehicle is not operated at the GVW. By basing vehicle launch metrics on the vehicle operating at the GVW it may be possible to provide more consistent vehicle performance when the vehicle is operated over a wide range of vehicle weight.

At 830, method 800 determines an underperformance adaptive driver demand correction. The underperformance adaptive driver demand correction may increase engine brake torque for prescribed driver input so that the vehicle accelerates at a rate that is greater than the rate the vehicle accelerated using the present value of the adaptive driver demand correction. In one example, the underperformance adaptive driver demand may be extracted from a table or function of empirically determined underperformance adaptive driver demand corrections. In other examples, the underperformance adaptive driver demand correction may be based on the difference between the desired launch metrics and the actual launch metrics multiplied by a predetermined factor. Method 800 proceeds to 832 after the underperformance adaptive driver demand correction is determined.

At 832, method 800 judges whether or not the underperformance adaptive driver demand correction is within predetermined learning limits. For example, the underperformance adaptive driver demand correction may be judged to be within a range of values. If method 800 judges that the underperformance driver demand correction is within learning limits the answer is yes and method 800 proceeds to 834. Otherwise, method 800 proceeds to exit and the adaptive driver demand correction is not updated.

Thus, the methods of FIGS. 4-8 provide for s method for operating an engine of a vehicle, comprising: providing a driver input device for determining a driver demand torque; transforming a signal from the driver input device into a driver demand torque via a transfer function that is based on operating the vehicle at a gross vehicle weight; and adapting the transfer function in response to vehicle weight being less than a gross vehicle weight. The method includes where the driver input device is an accelerator pedal, and further comprising estimating the vehicle mass via a vehicle height sensor.

In some examples, the method includes where the transfer function is adapted in response to barometric pressure. The method further comprises adjusting a performance factor adjustment in response to vehicle weight being less than the gross vehicle weight. The method includes where a position of the driver input device changes with rotation of a driver's foot, and further comprising adapting values of the transfer function that exceed a present value of the transfer function. The method further comprises adapting the transfer function for vehicle environmental conditions including barometric pressure. The method further comprises not adapting the transfer function in response to a parameter being outside of predetermined limits.

In some other examples, the methods of FIGS. 4-8 provide for operating an engine of a vehicle, comprising: providing a driver input device for determining a driver demand torque; transforming a signal from the driver input device into a driver demand torque via a transfer function that is based on operating the vehicle at a gross vehicle weight; adapting the transfer function at a first rate in response to a vehicle parameter being greater than a first threshold; and resetting the transfer function to a base transfer function in response to the vehicle parameter being less than a second threshold. The method includes where the transfer function is reset to the base transfer function immediately in response to the vehicle parameter being less than the second threshold.

The method may also include where the transfer function is adapted after a tip-out. The method includes where the transfer function is adapted in response to the driver input device being in a base position. The method includes where a value of the transfer function is adapted before the driver input device is operated at position that corresponds to the adapted value. The method includes where values of the transfer function are adjusted in increments less than a first value when the driver input device is applied to a first value greater than a first threshold value, and where values of the transfer function are adjusted in increments greater than the first value when the driver input device is applied to a second value less than the first threshold value. The method further comprises adjusting a performance factor in response to desired vehicle performance. The method further comprises limiting vehicle acceleration in response to vehicle weight being less than the gross vehicle weight, vehicle acceleration being limited to vehicle acceleration at gross vehicle weight.

As will be appreciated by one of ordinary skill in the art, the method described in FIGS. 4-8 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps, methods, or functions may be repeatedly performed depending on the particular strategy being used. Further, the methods described may be implemented in hardware, software, or a combination of hardware and software. Further still, the methods may be stored as executable instructions in a non-transitory medium in the system shown in FIGS. 1 and 2.

This concludes the description. The reading of it by those skilled in the art would bring to mind many alterations and modifications without departing from the spirit and the scope of the description. For example, single cylinder, I2, I3, I4, I5, V6, V8, V10, V12 and V16 engines operating in natural gas, gasoline, diesel, or alternative fuel configurations could use the present description to advantage.

The invention claimed is:

1. An engine system for a vehicle, comprising:

an engine including an actuator; and a controller operatively coupled to the engine and the actuator, the controller including instructions stored in non-transitory memory to transform a signal from an accelerator pedal into a driver demand torque via a transfer function stored in a table, and further instructions to adjust values of the transfer function stored in the table during vehicle acceleration in response to a difference between a desired vehicle acceleration and an actual vehicle acceleration, and further instructions to apply the adjusted values of the transfer function stored in the table in response to the accelerator pedal being in a base position including delaying application of the adjusted values until after a throttle tip-out, and to adjust the actuator to vary engine torque based on the adjusted values of the transfer function.

2. The engine system of claim 1, further comprising additional instructions to estimate a vehicle weight via a vehicle height sensor and where the engine actuator is adjusted to adjust spark timing.

3. The engine system of claim 1, where the transfer function stored in the table is adapted in response to barometric pressure, and where the engine actuator is adjusted to adjust boost pressure, and further comprising:

additional executable instructions stored in the non-transitory memory to adjust the values of the transfer function in increments less than a first value when the accelerator pedal is applied in an amount greater than a first threshold value, and where the values of the transfer function are adjusted in increments greater than the first value when the accelerator pedal is applied in an amount less than the first threshold value.

4. The engine system of claim 1, where the transfer function stored in the table is adapted via an adaptive driver demand correction multiplier, the adaptive driver demand correction multiplier based on the difference between the desired vehicle acceleration and the actual vehicle acceleration, and where the engine actuator is adjusted to adjust fuel injection timing.

5. The engine system of claim 1, where a position of the accelerator pedal changes with rotation of a driver's foot, and further comprising additional instructions to determine an underperformance multiplier in response to the desired vehicle acceleration being greater than the actual vehicle acceleration.

6. The engine system of claim 5, further comprising additional instructions to determine an over performance multiplier in response to the desired vehicle acceleration being less than the actual vehicle acceleration.

7. The engine system of claim 6, further comprising additional instructions to cease to adapt the values of the transfer function stored in the table in response to the underperformance multiplier.

8. An engine system of a vehicle, comprising:

an engine including a plurality of actuators; and a controller operatively coupled to the engine and the plurality of actuators, the controller including instructions stored in non-transitory memory to transform a signal from a driver input device into a driver demand torque, the driver demand torque based on a transfer function stored in a table, and additional instructions to determine a plurality of parameters that adjust at least one of the plurality of actuators in response to a difference between a desired vehicle acceleration and an actual vehicle acceleration being greater than a threshold and an underperformance adaptive driver demand correction being within predetermined limits, the underperformance adaptive driver demand correction based on the difference between the desired vehicle acceleration and the actual vehicle acceleration multiplied by a predetermined factor, and additional instructions to adjust at least one of the plurality of actuators via the controller to vary engine torque when the underperformance adaptive driver demand correction is within the predetermined limits, and additional instructions to adjust values of the transfer function during vehicle acceleration and to apply the adjusted values of the transfer function in response to the driver input device being in a base position including delaying application of the adjusted values of the transfer function until after a throttle tip-out, and where applying the adjusted values includes determining the driver demand torque via the adjusted values.

9. The engine system of claim 8, further comprising additional instructions to judge if the vehicle will under-achieve wide open throttle performance based on a rate of vehicle acceleration at a prescribed engine load, and where at least one of the plurality of actuators adjusts boost pressure, and further comprising:

additional executable instructions in the non-transitory memory to adjust the values of the transfer function in increments less than a first value when the driver input device is applied in an amount greater than a first threshold value, and where the values of the second transfer function are adjusted in increments greater than the first value when the driver input device is applied in an amount less than the first threshold value.

10. An engine system, comprising:

an engine including an actuator;

a turbocharger coupled to the engine; and a controller operatively coupled to the engine and the turbocharger, the controller including instructions stored in a non-transitory medium to adjust a driver input variable via adding an adaptive driver demand correction to the driver input variable, the adaptive driver demand correction adjusted in response to an absolute value of a desired vehicle acceleration minus an actual vehicle acceleration not being less than a threshold, and further instructions to adjust the actuator via the controller responsive to the adjusted driver input variable, the adaptive driver demand correction including values of a transfer function adapted during vehicle acceleration, the values of the transfer function applied in response to a driver input device being in a base position including delaying application of the adjusted values until after a throttle tip-out.

11. The engine system of claim 10, where the driver input device is an accelerator pedal, where the values are applied to determine a driver demand torque, and where the actuator adjusts boost pressure, and further comprising:

additional executable instructions stored in the non-transitory memory to adjust values of the transfer function in increments less than a first value when the driver input device is applied in an amount greater than a first threshold value, and where values of the transfer function are adjusted in increments greater than the first value when the driver input device is applied in an amount less than the first threshold value.

12. The engine system of claim 11, further comprising additional instructions to adjust the adaptive driver demand correction based on the desired vehicle acceleration minus the actual vehicle acceleration multiplied by a predetermined factor.

13. The engine system of claim 10, where the adaptive driver demand correction is extracted from a table of empirically determined driver demand corrections.

14. The engine system of claim 10, where the actuator is a valve timing actuator.

15. The engine system of claim 10, further comprising additional instructions to adjust the driver input variable in response to vehicle weight.

16. The engine system of claim 10, further comprising additional instructions to adjust the adaptive driver demand correction in response to barometric pressure via multiplying the adaptive driver demand correction and a factor, the factor being present barometric pressure divided via a nominal barometric pressure.

* * * * *